United States Patent [19]

Ro et al.

[11] 4,350,529

[45] * Sep. 21, 1982

[54] CORROSION-RESISTANT POWDER-METALLURGY STAINLESS STEEL POWDERS AND COMPACTS THEREFROM

[75] Inventors: David H. Ro, Cleveland Heights; Erhard Klar, Beachwood; Charles I. Whitman, Bay Village, all of Ohio

[73] Assignee: SCM Corporation, New York, N.Y.

[ * ] Notice: The portion of the term of this patent subsequent to Dec. 23, 1997, has been disclaimed.

[21] Appl. No.: 161,552

[22] Filed: Jun. 20, 1980

Related U.S. Application Data

[63] Continuation-in-part of Ser. No. 10,956, Feb. 9, 1979, Pat. No. 4,240,831.

[51] Int. Cl.[3] ..... B22F 3/00

[52] U.S. Cl. ..... 75/228; 75/0.5 C; 75/200; 75/211; 75/224; 75/251

[58] Field of Search ..... 75/0.5 BA, 0.5 C, 200, 75/211, 224, 228, 251

[56] References Cited

U.S. PATENT DOCUMENTS

| | | | |
|---|---|---|---|
| 2,956,304 | 10/1960 | Batten et al. | 75/0.5 C |
| 3,243,288 | 3/1966 | Feldmann et al. | 75/0.5 BA |
| 4,154,608 | 5/1979 | Carey et al. | 75/0.5 BA |
| 4,240,831 | 12/1980 | Ro et al. | 75/0.5 BA |

FOREIGN PATENT DOCUMENTS

| | | | |
|---|---|---|---|
| 52-35708 | 3/1977 | Japan | 75/0.5 BA |

OTHER PUBLICATIONS

Kalish et al; "*An Evaluation of Dissociated Ammonia and Hydrogen Atmospheres for Sintering Stainless Steel*", Journal of Metals, TRANS. AIME., Feb. 1955, pp. 304–310.

Stosuy et al; *Metal Progress* vol. 91, pp. 81–85, 1967.

Jones; "*The Effect of Processing Variables on the Properties of Type 316L Powder Compacts*", *Progress in Powder Metallurgy*, vol. 30, pp. 25–50, Apr. 1974.

Sands et al; "*The Corrosion Resistance of Sintered Austenitic Stainless Steel*", *Modern Developments in Powder Metallurgy*, H. H. Hausen, ed., Plenum Press, N.Y., pp. 73–83, 1966.

*Primary Examiner*—Mark Bell

*Attorney, Agent, or Firm*—Robert A. Sturges; Merton H. Douthitt

[57] ABSTRACT

A process is disclosed for improving the corrosion resistance of stainless steel powders produced by atomization in an oxidizing atmosphere whereby silicon present in the powder tends to form silicon oxides on the powder surface. The process comprises adding an effective proportion of a modifier metal selected from the group consisting of antimony, arsenic, and bismuth to the melt prior to atomization. The modifier metal addition is effective for decreasing the surface silicon oxides and thereby improves the corrosion resistance.

10 Claims, No Drawings

CORROSION-RESISTANT POWDER-METALLURGY STAINLESS STEEL POWDERS AND COMPACTS THEREFROM

This is a continuation-in-part of copending application Ser. No. 010,956 filed on Feb. 9, 1979 now U.S. Pat. No. 4,240,831.

BACKGROUND OF THE INVENTION

The present invention relates to powder metallury (P/M) stainless steel powders and compacts therefrom, and more particularly to improving the corrosion resistance of such powders and compacts.

Heretofore, poor corrosion resistance of such compacts has been attributed mainly to the porosity found within the compacts, thus most techniques for overcoming corrosion problems have been aimed at closing the porosity. Prior techniques aimed at minimizing the surface porosity of the compacts made from such stainless steel powders include mechanical closure treatment, plastic impregnation, surface coatings, or passivation treatments. Each of these techniques has some limitation as to its effectiveness in addition to raising the cost of the final product. Other proposals aimed at improving the corrosion resistance of stainless steel powder compacts concentrate on compacting and sintering parameters. These proposals generally state that the sintering conditions and sintering atmosphere have a marked influence on the corrosion properties of the powder compact; however, most of the experimental results reported in these proposals are inconsistent. For example, Kalish and Mazza ("*An Evaluation of Dissociated Ammonia and Hydrogen Atmospheres for Sintering Stainless Steel*", *Journal of Metals,* TRANS, AIME., February 1955, pages 304–310) state that sintering in hydrogen provides a more corrosion-resistant compact than sintering in dissociated ammonia which gives rise to a fourfold increase in the corrosion rate of the compact. Stosuy et al (*Metal Progress,* Vol. 91, pages 81–85, 1967) and Jones ("*The Effect of Processing Variables on the Properties of Type* 316*L Powder Compacts*", *Progress in Powder Metallurgy,* Vol. 30, pages 25–50, April 1974) report that an optimum combination of mechanical properties and corrosion resistance of the compact can be obtained by sintering the compact in dissociated ammonia. Furthermore, Sands et al ("*The Corrosion Resistance of Sintered Austenitic Stainless Steel*", *Modern Developments in Powder Metallurgy,* Vol. 2., H. H. Hausner, ed., Plenum Press, New York, N.Y., pages 73–83, 1966) report that while sintering in vacuo always gives a good corrosion-resistant product, sintering in either dissociated ammonia or hydrogen can lead to loss of corrosion resistance. With respect to sintering in dissociated ammonia, there is some evidence which points to the probable formation of chromium nitrides during cooling of the resultant dissociated ammonia-sintered compact which results in localized chromium depletion and, thus, loss of effective corrosion protection of the sintered compact. Certainly, the inconsistencies among these various citations demonstrate the confusion prevalent in the art with regard to the corrosion resistance of stainless steel powder and compacts made therefrom.

Another proposal for improving the corrosion resistance of stainless steel powder compacts is disclosed in Japanese Tokkai 35708 (1977). According to said disclosure, the addition of a small proportion of tin, and optionally copper also, improves the corrosion resistance of stainless steel compacts. This reference, however, does not provide any basis for concluding that other additions might also influence corrosion resistance and may even have negative implications.

It now has been discovered that stainless steel powders atomized in an oxidizing environment (e.g. a conventional water atomization process) are surface-enriched in silicon oxides (primarily silicon dioxide) and, thus, surface-depleted in chromium. Such depletion or loss of chromium about or at the surface of the powder is believed to lead to the poor corrosion resistance of the powder and more importantly of the ultimate compact made from such powder. "Surface-enrichment" in this application means that the composition of the powder or compact about its surface is substantially different from the bulk composition of the powder with a marked increase of silicon oxides being located about the surface of the powder (or compact) or within close proximity to the surface (e.g. about 0.5 micrometers into the powder or compact from the surface). Effective removal of such silicon oxides (the term "silicon oxide" is intended to refer to the various forms of oxidized silicon which primarily is believed to be silicon dioxide, but is not intended to be a limitation of the present invention) about the surface provides unexpected superior corrosion resistance of the powder and compact made therefrom.

BROAD STATEMENT OF THE INVENTION

The present invention is a process for increasing the corrosion-resistance of stainless steel powder or a compact thereof wherein a melt of metals is atomized for producing stainless steel powder in an oxidizing environment whereby the resulting stainless steel powder is surface-enriched in silicon oxides. Such improvement comprises adding an effective proportion of a Group V-a element having an atomic weight in excess of 70 to said melt prior to said atomization, said added element being capable of enrichment about the surface of said resulting atomized stainless steel powder and effective under reductive sintering conditions in the depletion of said silicon oxides about said surface; and optionally compacting and sintering said resulting atomized powder into a sintered compact thereof under reducing conditions, said powder or sintered compact thereof being depleted in said silicon oxides and the corrosion resistance of said powder or compact thereof being improved thereby.

DETAILED DESCRIPTION OF THE INVENTION

In our copending application Ser. No. 010,956 now U.S. Pat. No. 4,240,831, it was disclosed that other modifier metals were effective in enhancing the corrosion resistance of stainless steel powder and compacts thereof. These other modifier metals include aluminum, lead, magnesium, and rare earth metals. It has now been found that some Group V-a metals are effective modifier metals for improving the corrosion resistance of stainless steel powder. Arsenic, antimony, and bismuth are all effective in the present process and antimony is preferred. Typically, additions of about 0.1% to about 5.0% are effective; however, for reasons of economy additions of less than 1.5% are preferred. When added to the stainless steel alloy melt, these metals are found to be enriched about the surface of the resulting atomized stainless steel powder, though no satisfactory explanation for this surface-enrichment presently is known. Currently, there is no satisfactory understanding as to why these dissimilar metals perform in the stainless steel alloy powders and compacts thereof as they do.

An important characteristic of the present modifier metals is that they become enriched about the surface of the resulting atomized stainless steel powder. By surface-enrichment is meant that the weight concentration of the metal about the surface of the powder is substantially more than the bulk weight concentration of the metal in the alloy composition. Also, surface-enrichment includes the surface and about 0.01 and up to about 1 micrometer into the powder itself. The present modifier metals are found surface-enriched about the powder predominantly as an oxide following atomization of the melt. However, they may reside as oxides or even mixed oxides, or in elemental form about the surface of the resulting atomized powder. It is believed that surface-enrichment is important for successful practice of the invention and not the particular form taken by the modifier metal.

A second important characteristic is that the modifier metal promotes the depletion of silicon oxides from the surfaces of the stainless steel powder or compact thereof. It is not known whether the silicon oxides are reduced to silicon monoxide, for example, and volatilized from the stainless steel during sintering, or are reduced to elemental silicon which rediffuses into the powder or compact thereof during the sintering operation. Likely, both of these results are occurring. Of importance, only, is that the silicon oxides be depleted from the surfaces of the powder or compact thereof and it appears of little, if any, significance whether the silicon itself is removed from the stainless steel or remains in its elemental form.

While various theories can be propounded as to why antimony and like modifier metals operate in the process, a precise reaction mechanism presently is unknown. A possible explanation is that the modifier metal or an oxide thereof may act as a catalyst for removal of silicon oxides from stainless steel powder. Possibly other reaction mechanisms or even combinations thereof explain the process. Regardless of the explanation, the results are of importance and are readily determinable. It should be appreciated that the analyses required for atomized stainless steel powders which are very small in size are directed just on the surface of such particles. Also, concentrations are in parts per million of a metal or oxide on such surface. Gathering of precise data, therefore, is difficult.

Other desirable, though not necessary, properties of the modifier metal should be recognized, especially for good commercial practice of the invention. Preferably, the modifier metal should not adversely effect the mechanical properties of the compacted part, such as transverse rupture strength or the like. Also, such modifier metal should be non-staining and not interfere with the compacting operation. A decided benefit of the invention is that compacting of the stainless steel powder is improved by practice of the process so that, for example, lower compacting pressures can be used. Further, it is implicit in the invention, of course, that the modifier metal or oxide thereof itself does not promote corrosion of the stainless steel powder or compact thereof.

The present invention is applicable to all types of stainless steel powders whether conventionally classified as ferritic, austenitic, or a specialty stainless steel powder. It is possible by the present invention to take a lower grade stainless steel powder and upgrade its corrosion performance to that of a more expensive stainless steel powder, which is an especially valuable feature of the invention. Major elements used in forming a stainless steel alloy powder are iron, chromium, and nickel with a wide variety of minor alloying elements being present, some for achieving desired mechanical and/or physical properties of the ultimate sintered part made from the stainless steel powder and some from adventitious sources, e.g. as impurities, and the like. Reference is made to the AISI Series of stainless steel grades for amplification on the particular elements comprising various stainless steel alloys suitably formulated into "powder metallurgy" (P/M) stainless steel powders.

Water atomization is the preferred manufacturing procedure for producing the stainless steel powders (a powder metallurgy process), though various gas atomization processes may be used. U.S. Pat. No. 2,956,304 depics a typical water atomization apparatus and method for practice of this process. The stainless steel particles average size (weight average diameter) typically is less than 325 mesh though the distribution of particles ranges from finer than this on up to 100 mesh and larger (United States Standard Sieve Series).

Stainless steel powders then are compacted for forming a wide variety of parts. Compacting by consolidation, unidirectional die, isostatic techniques, rolling techniques, vibratory techniques, optionally with extrusion, all are suitable for forming parts from the novel stainless steel powders of the present invention. Further on compacting techniques can be found in Kirk-Othmer, *Encyclopedia of Science and Technology,* Vol. 16, 2nd Edition, pages 401–435, Interscience Publishers, New York, N.Y. (1968), the disclosure of which is expressly incorporated hereby by reference. Densification from about 60% of theoretical on up to full dense parts is practiced conventionally and for the present invention. Formation of wrought articles from the stainless steel powder may be practiced also.

Because of the oxidizing-environment prevailing during the water atomization or like procedure (e.g. gas atomization with water or wet collection) used for manufacturing the stainless steel powders, the powder and a compact thereof are enriched in various oxides of some of the metals used to formulate the stainless steel alloy with some of these oxides enriched about the surface of the powder. The concentration of such silicon oxides about the surface of the powder typically is in a range of about 20% to 40% by weight. Reduction of such silicon oxides about the surface of the stainless steel powder unexpectedly provides substantial corrosion resistance to the stainless steel powder and compact thereof. It also should be noted that other oxides can form from the atomization process and some of these additionally may be enriched about the surface of the stainless steel particles. Such other oxides additionally can contribute to undesirable properties of the powder and such other oxides preferably are reduced simultaneously in the present invention. An example of such other undesirable metal oxide is manganese oxide which significantly contributes to discoloration of the stainless steel powder and compact thereof. Reduction of such other metal oxides may permit lower grade stock to be used in the alloy melt for making the stainless steel powders because the present invention substantially suppresses the adverse affect which such other metal oxides would otherwise display.

Experimental testing indicates that corrosion resistance of the stainless steel powder or compact thereof increases with decreasing proportions of silicon oxides about the surface of the powder. It appears that around 1000–1200 ppm silicon oxide and less, that substantial improvement in corrosion resistance results. Certainly, less than about 800 ppm silicon oxides about the surface of the powder is preferred. Again, precise values are difficult to determine due to analytical equipment limitations in accurately measuring such small quantities of metals (or oxides) on the surface of the powder.

Referring to reductive sintering, temperatures of at least about 2300° F. and dew points of lower than about −60° C. are most effective, yet extremely difficult and costly to achieve on a commercial scale. An advantage of the present invention is that relatively mild sintering conditions can be used to provide superior stainless steel parts. Accordingly, effective sintering conditions for the present invention include temperatures of about 2000° to 2200° F. with dew points not much lower than about −40° F. Most present commercial manufacturing plants easily and economically can handle such sintering conditions. Hydrogen gas is preferable for reductive sintering, though most commercial manufacturers find hydrogen gas expensive and often dangerous at the elevated temperatures of sintering. Accordingly, the present invention operates exceptionally using dissociated ammonia for the sintering operation. Furthermore, vacuum sintering may be employed at temperatures of about 2100° to 2500° F. in the presence of reagents or catalysts and the silicon oxides effectively removed. (See Samsonov, "The Oxide Handbook", Chapter 7, IFI/Plenum Data Corp., New York, New York, 1973; incorporated herein).

Another benefit of the invention is the improvement in compacting which the improved corrosion-resistant stainless steel powder of this invention provides. High dense parts can be pressed using relatively lower compacting pressures than heretofore could be used for powder metallurgy stainless steel powders. Superior full dense parts which possess excellent corrosion resistance are achievable with the present invention.

The following Examples will further elaborate and illuminate the present invention. Such examples show how the present invention can be practiced but should not be construed as limiting. In this application, all parts and percentages are by weight, all temperatures are in degrees Fahrenheit, and all other units are in the Metric System unless otherwise indicated.

IN THE EXAMPLES

In the examples, the stainless steel powder tested was type 316L having the following typical chemical and sieve analyses:

TABLE 1

| Elements | Weight Percent |
|---|---|
| C | 0.019 |
| Si | 0.780 |
| Mn | 0.130 |
| S | 0.020 |
| Cr | 16.200 |
| Mo | 2.060 |
| Ni | 13.140 |
| Fe | Balance |

TABLE 2

| Powder Fraction (Tyler Mesh) | Weight Percent |
|---|---|
| >100 | 2.3 |
| 100/150 | 8.1 |
| 150/200 | 16.2 |
| 200/325 | 25.3 |
| <325 | 48.1 |

The powder was produced by a conventional water-atomization technique in a nitrogen atmosphere.

Specimens approximately 32×13×3 mm were compacted at 276–827 megapascals in a double-acting die set depending on the final part density desired (6.6±0.03 gm/cc). Normally, 1% lithium stearate was used as an admixed lubricant during compaction. Green compacts were subjected to a burn-off treatment at 1000° F. for 30 minutes in air prior to sintering. Sintering was conducted by placing the specimens in stainless steel boats. Corrosion tests were 5% salt spray tests conducted according to ASTM B 117-64. The time at which about 1% of the surface of the specimen visually appeared to show corrosion then was recorded.

Surface analyses were performed using electron spectroscopy for chemical analysis (ESCA) and Auger electron spectroscopy (AES) techniques. ESCA work was conducted on the VIEE-15 electron spectrometer equipped with electrostatic analyzers (Varian Analytical Instrument Devices, Inc.). Auger analyses were performed on the AES system (PHI Model 510, Physical Electronics, Perkin-Elmer, Inc.) and the SAM-/ESCA system (PHI Model 550). The latter system is a combination of the ESCA/Auger electron spectrometer and the scanning Auger microprobe (SAM).

EXAMPLE 1

Two batches of type 316L stainless steel powder were made, the first containing 1.2% by weight antimony and the second containing no antimony added to the melt prior to atomization. Ten samples each of these batches were tested for corrosion resistance. All samples were subjected to a 5% neutral salt spray test according to ASTM B 117-64 and periodically inspected for signs of corrosion. Each sample compacted part had been sintered at 2150° F. in dissociated ammonia with a −40° F. or lower dew point prior to the corrosion tests. The following results were obtained.

TABLE I

| | Corrosion Time (Hours)[1] | | | |
|---|---|---|---|---|
| Sample | Until 10% of Samples Corroded | Until 20% of Samples Corroded | Until 40% of Samples Corroded | Until 60% of Samples Corroded |
| Regular 316L | 45 Hours | 65 Hours | 100 Hours | 160 Hours |
| 316L + 1.2% Sb | 75 Hours | 120 Hours | 210 Hours | 320 Hours |

[1]A sample was deemed to show corrosion when 1% or more of its surface visually appeared corroded.

The foregoing tabulated results clearly demonstrate the superior corrosion resistance of the stainless steel containing the additive metal antimony. Similarly additions of the related modifier metals, arsenic and bismuth, improve the corrosion resistance of stainless steel powder and compacts thereof.

What is claimed is:

1. In a process for atomizing a melt of metals for producing stainless steel powder, wherein said atomizing is conducted in an oxidizing environment whereby the resulting stainless steel powder is surface-enriched in silicon oxides, the improvement for increasing the corrosion resistance of said powder or a compact thereof which comprises:

adding an effective proportion of modifier metal prior to said atomization, said modifier metal selected from the group consisting of antimony, arsenic, and bismuth, each being capable of enrichment about the surface of said resulting atomized stainless steel powder and effective under reductive sintering conditions in the depletion of said silicon oxides about said surface.

2. The process of claim 1 wherein said modifier metal is antimony.

3. The process of claim 1 wherein said modifier metal is arsenic.

4. The process of claim 1 wherein said modifier metal is bismuth.

5. The process of claim 1 wherein said modifier metal is added to said melt in a proportion between about 0.1% and 5% by weight of said melt.

6. The process of claim 1 wherein said modifier metal is added to said melt in a proportion between about 0.1 and 1.5% by weight of said melt.

7. The process of claim 1 wherein said atomizing is by a water atomization process.

8. The process of claim 1 wherein said powder contains less than about 1200 ppm surface silicon oxides.

9. The powder product produced according to claim 1.

10. A sintered compact of the powder product produced according to claim 1.

* * * * *